US006652434B2

(12) United States Patent
Benzoni

(10) Patent No.: US 6,652,434 B2
(45) Date of Patent: Nov. 25, 2003

(54) DEVICE FOR FORMING BOX JOINING FLAPS IN A BOX SPLITTING MACHINE

(76) Inventor: Rinaldo Benzoni, Via Adamello, 3, 20035 Lissone (Milano) (IT)

( * ) Notice: Subject to any disclaimer, the term of this patent is extended or adjusted under 35 U.S.C. 154(b) by 0 days.

(21) Appl. No.: 10/113,349

(22) Filed: Apr. 1, 2002

(65) Prior Publication Data

US 2002/0142906 A1 Oct. 3, 2002

(30) Foreign Application Priority Data

Apr. 3, 2001 (IT) ..... MI2001A0716

(51) Int. Cl.[7] ..... B31B 3/14

(52) U.S. Cl. ..... 493/59; 493/245; 83/298; 83/299

(58) Field of Search ..... 83/289, 298, 299, 83/334, 335, 339; 493/51, 59, 63, 68, 127, 79, 245

(56) References Cited

U.S. PATENT DOCUMENTS

| | | | | | |
|---|---|---|---|---|---|
| 3,552,251 | A | * | 1/1971 | Neff et al. | 83/299 |
| 3,985,054 | A | * | 10/1976 | Marino | 83/303 |
| 4,064,792 | A | * | 12/1977 | Gess | 93/18 |
| 4,596,541 | A | * | 6/1986 | Ward, Sr. et al. | 493/59 |
| 5,546,838 | A | * | 8/1996 | Longwell | 83/37 |
| 5,964,686 | A | * | 10/1999 | Bidlack et al. | 493/59 |

* cited by examiner

*Primary Examiner*—Stephen F. Gerrity
*Assistant Examiner*—Tara Ho
(74) *Attorney, Agent, or Firm*—Hedman & Costigan, P.C.

(57) ABSTRACT

An improved device for forming box joining flaps in a box splitting machine comprises a supporting frame for supporting a joining flap cutting assembly, the supporting frame being transversely driven with respect to the paperboard material feeding direction, by a worm screw in turn driven by a geared motor unit controlled by a controlling electronic apparatus.

15 Claims, 7 Drawing Sheets

DEVICE FOR FORMING BOX JOINING FLAPS IN A BOX SPLITTING MACHINE

BACKGROUND OF THE INVENTION

The present invention relates to an improved device, for application to a splitting machine, designed for processing corrugated board material, to make product packaging boxes and the like.

As is known, a splitting machine is designed for making suitable split and ribbed arrangements in the corrugated paperboard material, which is supplied, with a flat arrangement, at one end of the splitting machine.

The corrugated board portions, in particular, are trimmed, ribbed and die-cut, so as to be adapted for bending to make packaging boxes.

Prior paperboard material splitting or die-cutting machines, however, are affected by several drawbacks, mainly related to the machine portions which are used for forming, at one side end, the box joining flap.

Such a joining flap, more specifically, is a paperboard material side flap, which is used for closing the box by glueing or seaming.

Such a glueing or seaming operation, in particular, is at present performed by mechanical means, i.e. mechanical devices including a plurality of rotary blades, which are mounted on a top cutting blade supporting disc.

The cutting blades are arranged with a suitably slanted or inclined arrangement with respect to the cutting blade supporting disc and cooperate with abutment rings rotatively driven together with a bottom counter-splitting disc.

Thus, prior paperboard material splitting or die-cutting machines require a lot of labour consuming adjusting operations, since the mentioned bottom abutment rings, which are usually made of a polyurethane material, are quickly worn.

In a further prior embodiment, the mentioned bottom abutment rings are made of a hardened steel material.

In this case, on the other hand, it is necessary to manually adjust the cutting depth of the cutting blades, depending on the thickness of the paperboard material being processed.

Such an adjusting operation is necessary for preventing the joining flap cutting blades from being quickly worn, as well as to prevent the cutting blade holder shafts and bearings from being also quickly worn because of a comparatively high operating load.

Yet another prior paperboard material splitting or die-cutting machine provides to use top joining flap cutting blades, which are mounted in supporting recesses therefor, including a plurality of resilient spring or pressing-elements, urging the cutting blades so as to provide a suitable cutting pressure.

In this case too, the joining flap cutting blades work in cooperation with bottom abutment ring elements, made of a hardened steel material, mounted on a counter-splitting member.

While the latter paperboard material splitting machine is preferred with respect to the other above disclosed splitting or die-cutting machine, it, however, presents the drawback that it cannot be easily fitted, in its cutting pressure, to the different thicknesses of paperboard materials to be split or cut.

For example, as a joining flap is to be cut from a paperboard material having a thickness of 10 mm, then it would be necessary to provide a resilient spring adapted to apply a suitable cutting pressure, which must be comparatively high.

On the other hand, as, by the same machine, a paperboard material having a thickness of only 3 mm must be cut, then it is necessary to cause the steel ring element mounted on the bottom abutment splitting element to be approached, since it is necessary to drive towards one another the disc elements provided for allowing the paperboard material to be properly fed.

Under the above mentioned conditions, the joining flap cutting blades would excessively cut through the paperboard material because of a greater pressure of the spring, with a consequent quick wearing of the cutting blades.

Moreover, said cutting blades, also in this case, would apply an excessively great load on the cutting blade bearing shafts and bearing assemblies, thereby causing either a temporaneous or permanent flexure of said shafts and a quick wearing of the bearings.

Moreover, all the above disclose paperboard material splitting or die-cutting machines are affected by further drawbacks.

One of the latter is that as packages without joining flaps must be made, then it is necessary to manually disassemble the joining flap cutting blades, and then assemble them again for processing boxes including the joining flaps.

Furthermore, if a joining flap having a length greater than the height of a closed box must be made, then it is necessary to manually drive the cutting blades, with consequent complex operations to be performed by skilled operators.

SUMMARY OF THE INVENTION

Thus, the aim of the present invention is to provide such an improved device for forming joining flaps in box die-cutting or splitting machines, which allows to automatize and greatly simplify all the adjusting operations, so as to reduce to a minimum the wearing of the cutting blades.

Within the scope of the above mentioned aim, a main object of the present invention is to provide such an improved device which, for operation, does not require to disassemble the cutting blades for making boxes either including or not the joining flaps, or boxes including a greater length joining flap.

Another object of the present invention is to provide such an improved device allowing to fully eliminate any stresses from the cutting blade supporting bearings and rollers.

In fact, the joining flap cutting blades are mounted on a dedicated mounting assembly, located outside of the paperboard material splitting or die-cutting machine.

Thus, such a dedicated and outside joining flap cutting assembly does not require any manual adjusting for use, with the exception of the adjustment operations required for fitting the processed paperboard material thicknesses.

Moreover, the subject improved assembly allows to easily make joining flaps of any desired lengths, which could not be obtained in the above disclosed prior devices.

In fact, in the latter, the maximum length of the joining flap depends on the peripheral extension of the cutting blade supporting disc thereon are mounted the joining flap cutting blades.

Moreover, the device according to the invention provides the further advantage that it can be applied to all the existing paperboard material splitting or die-cutting machine, and, more specifically, at the paperboard material inlet and output sides thereof.

The device according to the present invention, moreover further comprises a trimming assembly for precisely trimming the processed paperboard material and for allowing a suitable fragmentation of the trim arrangement to be easily made.

The latter feature, in particular, would greatly facilitate the removal of the paperboard material trimmed waste thereby preventing any jamming from occurring.

The device for trimming and fragmentating the processed paperboard material does not require any pressure adjustments, with respect to the trim breaking blade, while providing all the disclosed operating advantages of the joining flap cutting assembly.

BRIEF DESCRIPTION OF THE DRAWINGS

Further characteristics and advantages of the improved device according to the present invention will become more apparent hereinafter from the following detailed disclosure with reference to the accompanying drawings, where.

DESCRIPTION OF THE PREFERRED EMBODIMENTS

Figure 1:
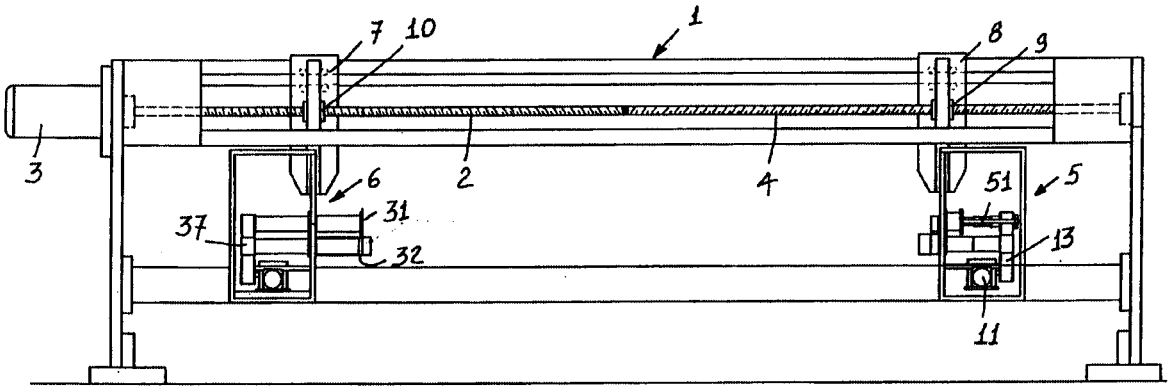
FIG. 1 is a front side view illustrating the improved device according to the invention.
Figure 2:
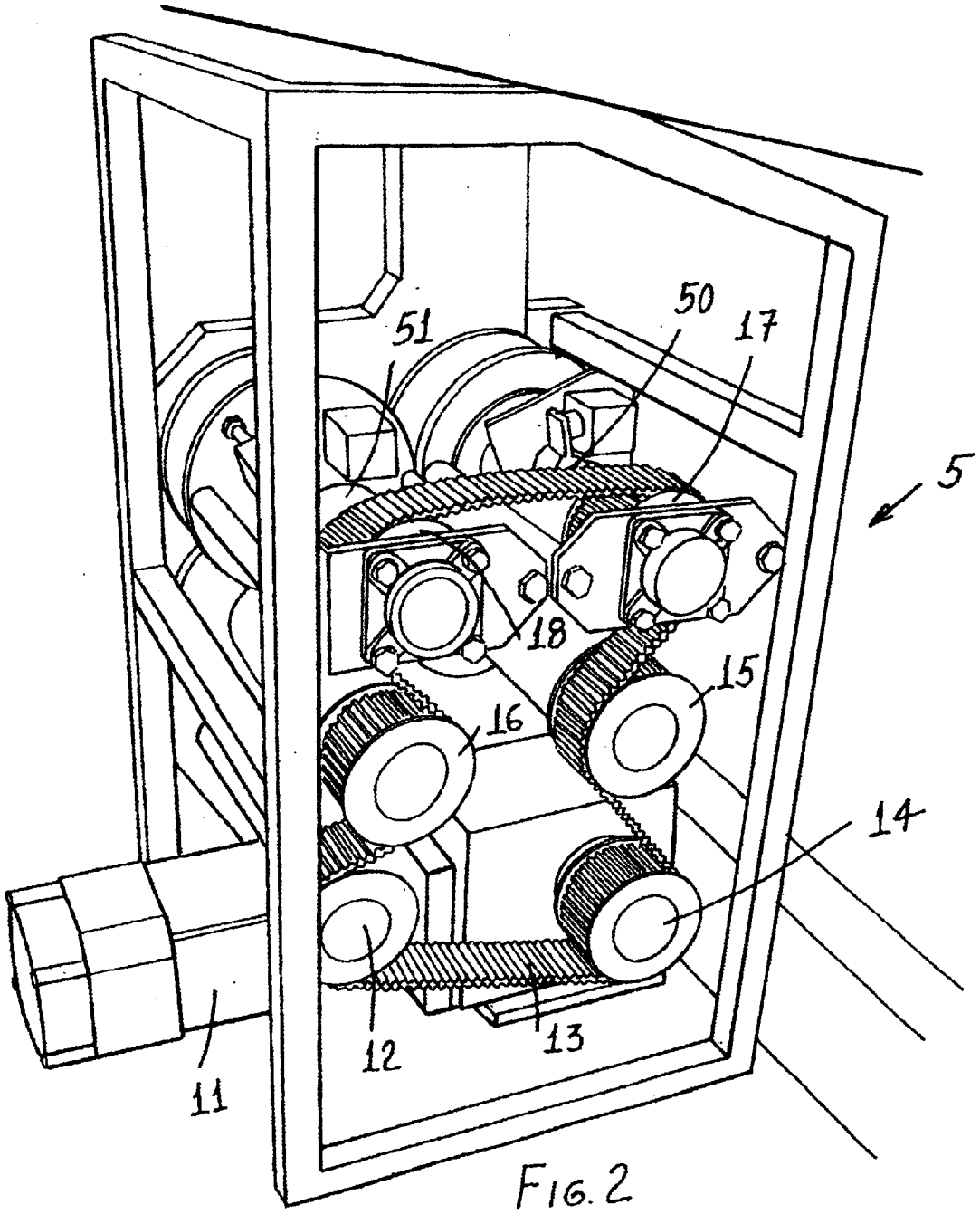
FIG. 2 is a side perspective view illustrating a detail of the assembly for making box joining flaps.

With reference to the number references of the figures of the accompanying drawings, the improved device 1 according to the present invention comprises a flap cutting assembly, supported on a framework 5 which can be driven transversely of the paperboard material feeding direction.

In particular, the framework 5 is supported by a supporting assembly 8 and is driven by a worm screw 4, engaging with a ring nut 9 and driven by a geared motor unit, controlled by a specifically designed electronic apparatus.

The geared motor unit 11 is supported by said framework 5 for operatively driving, through a toothed pulley 14, a toothed belt 13.

In this connection it should be pointed out that the above driving belt arrangement could be replaced by a chain and pinion driving assembly.

The belt 13 rotatively drives, through a transmission pulley 12, at least four toothed pulleys 15, 16, 17 and 18 which are rigid with corresponding rotatively driven shafts.

Figure 5:
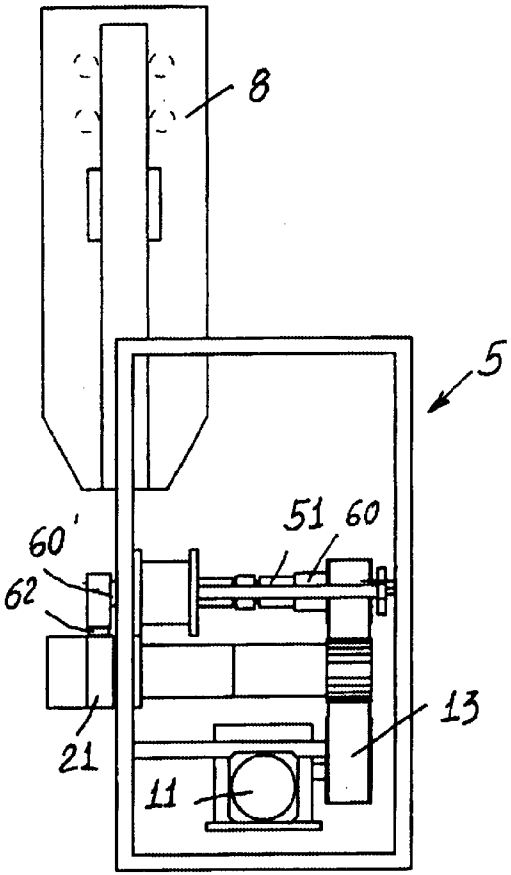
FIG. 5 is a side orthogonal view of the box joining flap making assembly.

In particular, the two top shafts are primary shafts, the first shaft 60 is shown in FIG. 5 and the second shaft not being shown comprise two friction assemblies 51, which are electrically driven, for allowing motion to be transmitted from said primary shafts to secondary shafts 60' and 61', at electronically present time periods.

Alternatively, the two primary shafts can be driven by electronically controlled motors.

As shown, the secondary shafts 60' and 61' support two rotary devices 19 and 20 in turn supporting a plurality of cutting blades or knives 62.

Thus, as the rotary devices 19 and 20 are rotatively driven, the cutting blades will respectively cut a paperboard material side flap, thereby forming the box paperboard flap 74, the length of which will be electronically preset, in setting the box dimensions.

The joining flap 74 cutting blades 62, during the paperboard material cutting operation, turn with two bottom ring elements 21 and 22 made of a hardened steel material.

The bottom ring elements 21 and 22 adjoin two further ring elements 23 and 24 coated by a rubber material and which, in turn, cooperate with top rubber wheels 23' and 24' supported by spring-urged arms.

Said ring elements 23 and 24 and wheels 23' and 24' rotate with a peripheral speed equal to that of the splitting and counter-splitting discs of the splitting machine.

Thus, the ring elements 23 and 24 and wheels 23' and 24' will cause the paperboard material to be evenly fed for cutting the joining flaps therefrom.

Figure 4:
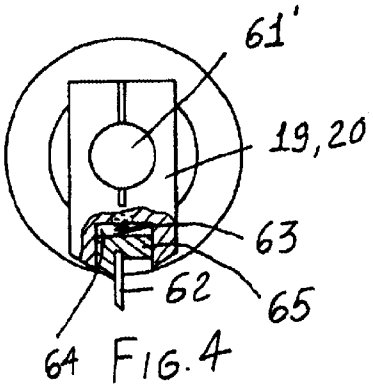
FIG. 4 is a detail view of the cutting blade supporting elements, designed for supporting a plurality of joining flap cutting blade.
Figure 3:
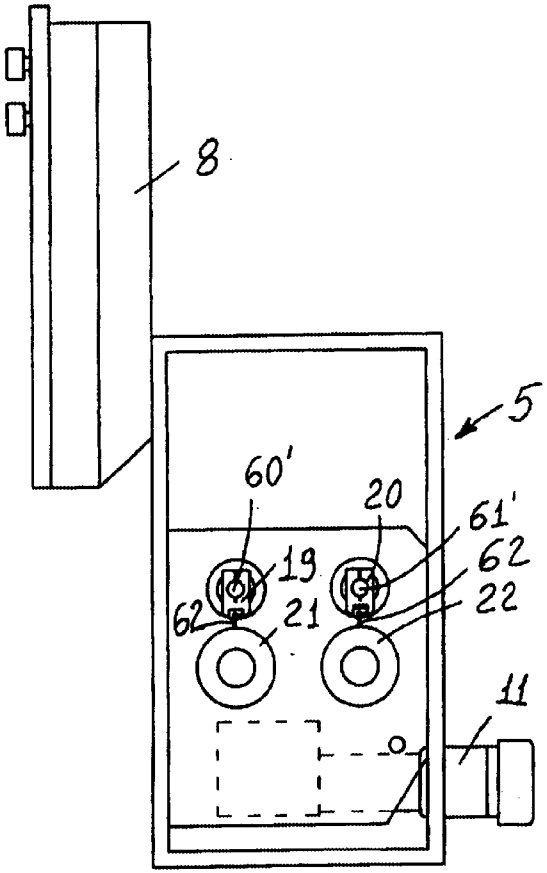
FIG. 3 is a side view illustrating the box joining flap making assembly.
Figure 7:
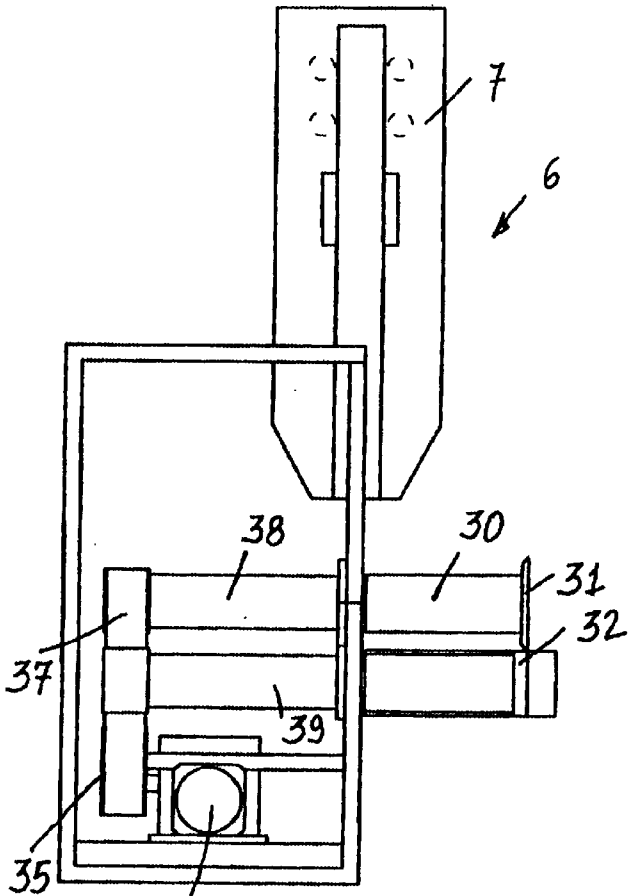
FIG. 7 illustrates a side view, orthogonal to the view of FIG. 6.
Figure 6:
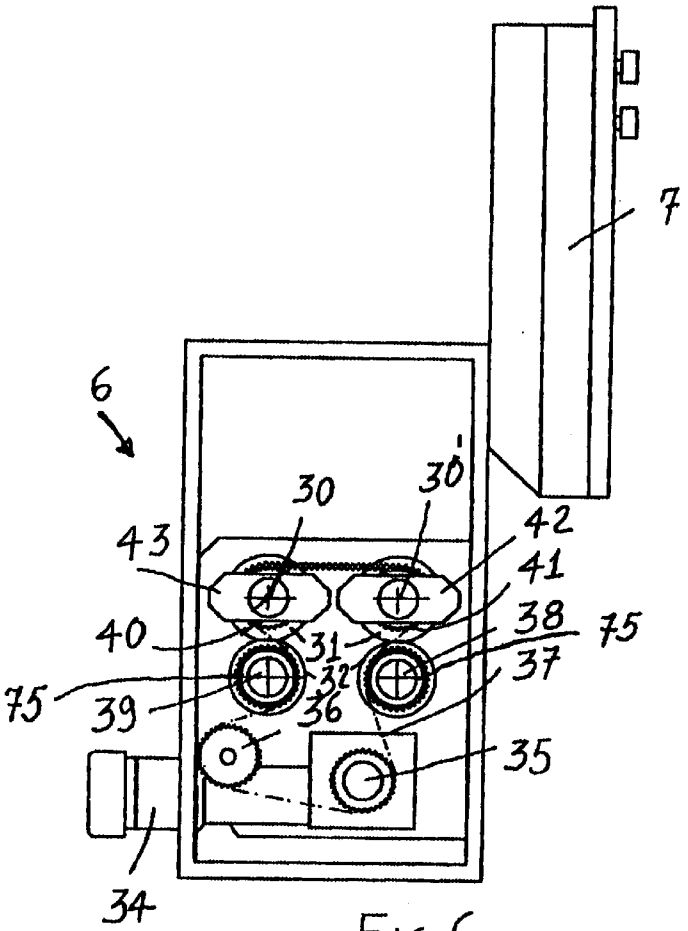
FIG. 6 is a side view showing the trimming assembly for trimming one end of a box, made by using a paperboard material splitting or die-cutting machine.
Figure 8:
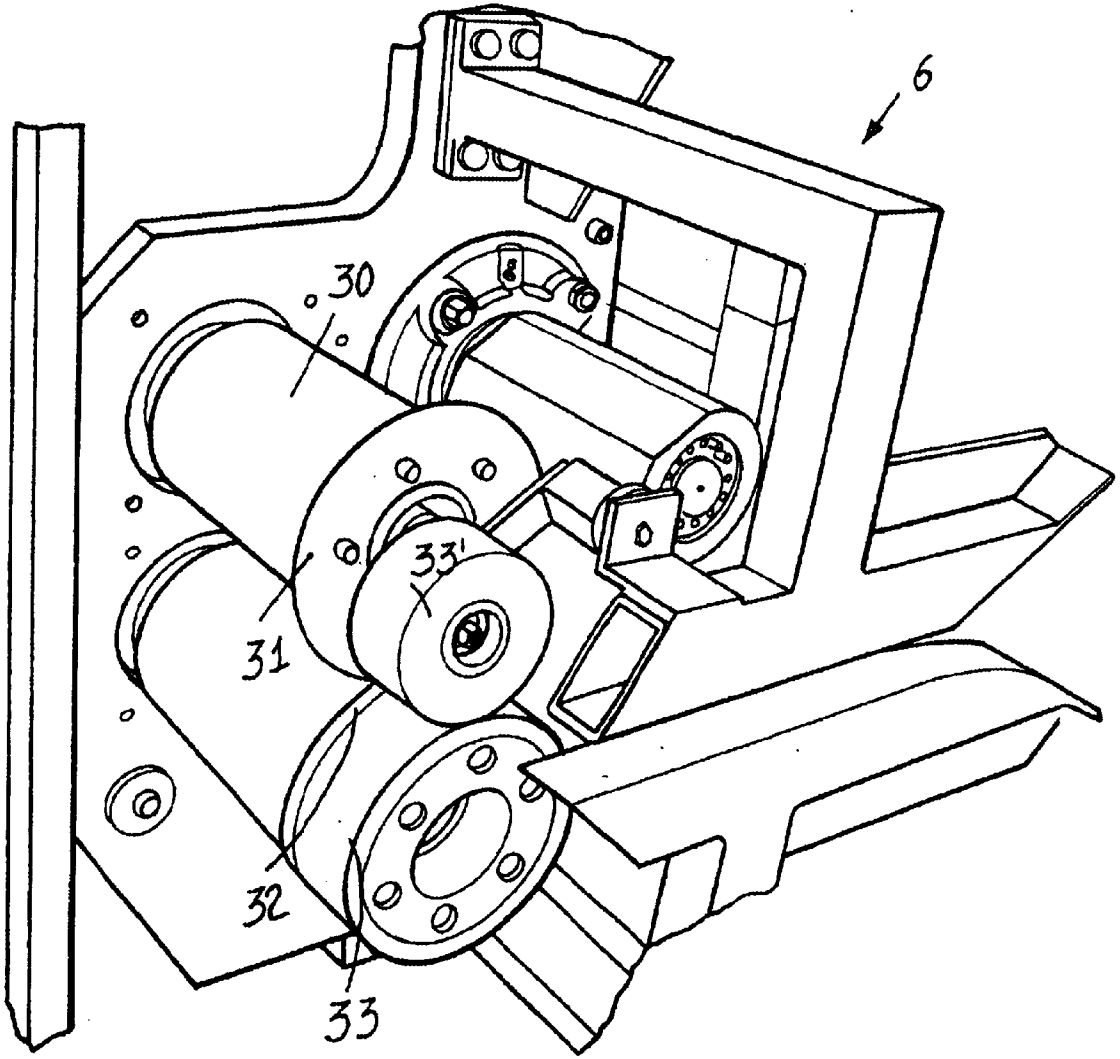
FIG. 8 is a top side perspective view of the trimming assembly for trimming a side end of the paperboard boxes.
Figure 9:
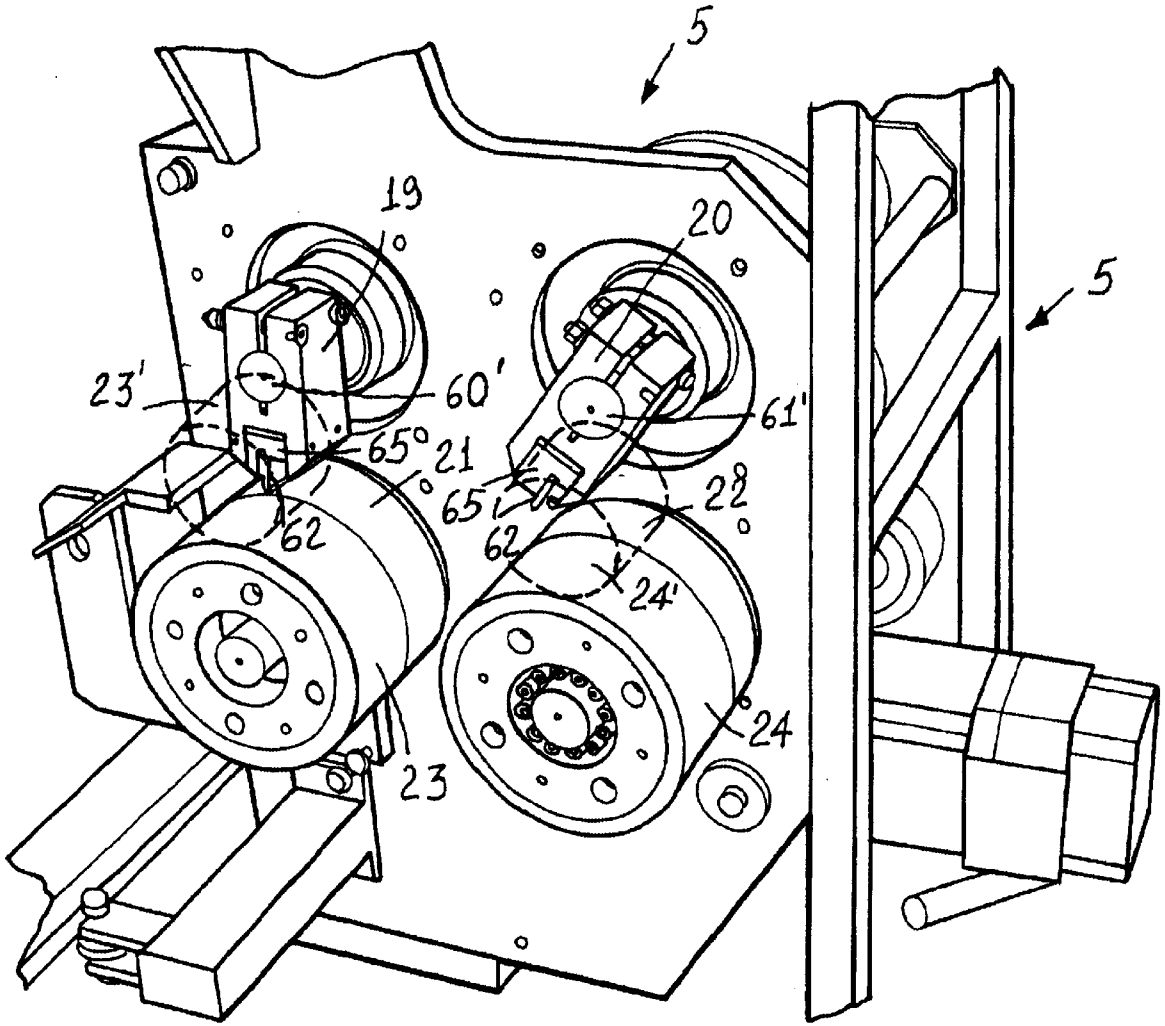
FIG. 9 is a further top side perspective view of the box joining flap making assembly.
Figure 10:
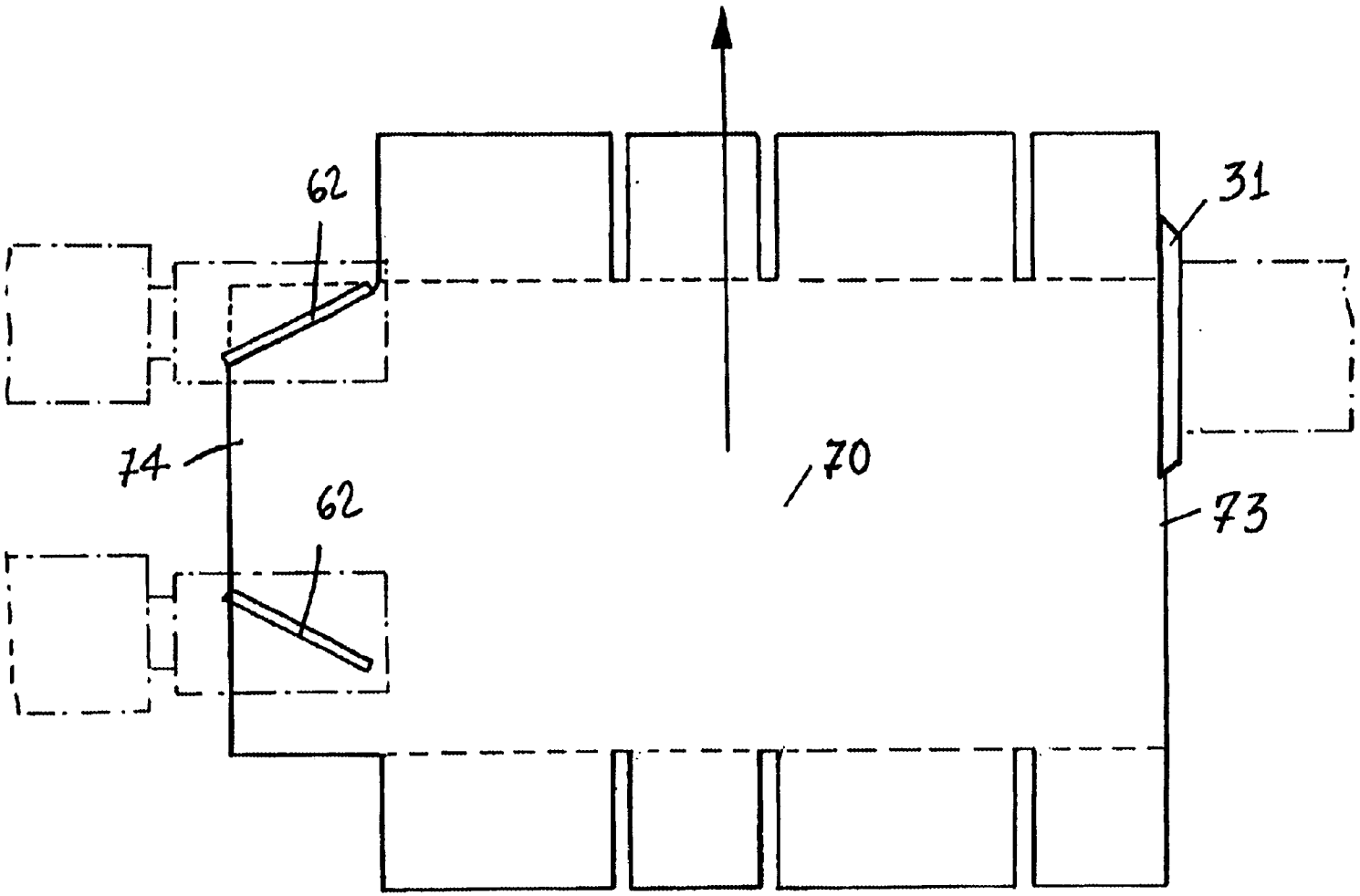
FIG. 10 is a schematic top plan view of an extended box, this view clearly showing the trimming operations for trimming one end of a box and for cutting the box joining flaps, at the end of the box opposite to the trimming end.

In this connection it should be pointed out that the joining flap blades 62, supported by the two top secondary shafts 60' and 61' comprise resilient material spacer elements 64, 65 (FIG. 4 pressed by a spring, allowing the cutting blades 62 to be urged by a constant pressure, thereby providing a perfect cutting of the joining flaps independently from the paperboard material thickness and type or quality.

The auxiliary trimming device for application to the paperboard material splitting machine and to corrugated paperboard material processing machines in general, comprises a supporting framework 6 which can be driven transversely of the paperboad material feeding direction.

The supporting framework 6, in particular, is supported by a supporting assembly 7 and is preferably driven by a geared motor unit 3, rotatively driving a worm screw 2 engaging with a ring-nut 10 applied to said supporting framework 6.

A second geared motor unit 34 drives either a toothed pulley 35 or a pinion.

The pulley 35, in turn, drives, through a toothed belt 37, at least four pulleys 40, 41 and 75, which are rigid with two top shafts 30,30' and two bottom shafts 38 and 39, the top two shafts 30,30', respectively, supporting top blades 31 and the two bottom shafts 38,39 supporting bottom counter blades 32 for trimming a side flap 73 of the paperboard material 7.

The rotary top shafts 30', 30 further support one or more top cross cutting blades 42 ,43 for transversely precutting the paperboard material portion to be trimmed.

The subject device further comprises, on the two sides thereof, spring-urged rubber wheels, cooperating with rubber coated ring elements 9 (not shown) for providing a perfect and even feeding of the paperboard material.

What is claimed is:

1. An improved device, to be applied to a paperboard material splitting machine having paperboard material splitting and counter-splitting means, for forming box joining-flaps, comprising a supporting frame for supporting a first supported framework of a joining flap primary cutting assembly, said first supporting framework being driven transversely to a paperboard material feeding direction, by a worm screw in turn driven by an electronically controlled geared motor unit, and a second supporting framework supporting an auxiliary trimming assembly and also driven transversely of said paperboard material feeding direction.

2. A device according to claim 1, wherein said geared motor unit drives, through a toothed pulley, a toothed belt rotatively driving at least four toothed pulleys, which are rigid with corresponding rotary shafts.

3. A device according to claim 2, wherein said rotary shafts comprise two top shafts supporting two mechanical friction assemblies, or electrically driven assemblies, for allowing motion to be transmitted from a primary shaft to a secondary shaft at mechanically or electronically set time periods, respectively.

4. A device according to claim 3, wherein said secondary shaft supports two cutting blade supporting rotary devices.

5. A device according to claim 4, wherein as said cutting blade supporting rotary devices are rotatively driven, said cutting blade supporting rotary devices respectively cut a front and rear flap of said paperboard material.

6. A device according to claim 5, wherein said joining flap cutting blades are rotatively driven, for cutting the paperboard material, in cooperation with two bottom hardened steel ring elements.

7. A device according to claim 6, wherein said hardened steel bottom ring elements adjoin two further rubber coated ring elements which cooperate with top rubber wheels supported by spring-urged arms.

8. A device according to claim 7, wherein said rubber coated ring elements and wheels turn with a peripheral speed equal to that of paperboard splitting and counter-splitting disc means of said paperboard splitting machine.

9. A device according to claim 8, wherein said rubber coated ring elements and wheels causes said paperboard material to be evenly fed as said joining flap is cut therefrom.

10. A device according to claim 7, wherein said joining flap cutting blades, supported by said two top secondary shafts, comprise resilient material spacer elements that apply even pressure to said cutting blades so as to cut the joining flap independently from a thickness and type of the paperboard material.

11. A device according to claim 1, wherein said device comprises a second geared motor unit driving a toothed pulley or a pinion.

12. A device according to claim 11, wherein said toothed pulley drives, through a toothed belt, a plurality of pulleys rigid with at least four shafts.

13. A device according to claim 12, wherein said at least four shafts include a top shaft and a bottom shaft, respectively support a cutting blade and a cutting counter-blade, for trimming a side flap of said paperboard material.

14. A device according to claim 13, wherein the other two shafts of said four shafts, which are also rotatively driven, respectively support one or more top cross cutting blades.

15. A device according to claim 14, wherein said one or more top cross cutting blades cooperate with a bottom roller, made of steel or of a polyurethane coated material to cross precut the paperboard materials portion to be trimmed.

* * * * *